United States Patent [19]

Clinnin et al.

[11] Patent Number: 4,775,154

[45] Date of Patent: Oct. 4, 1988

[54] PROMOTIONAL GAME

[75] Inventors: John V. Clinnin, Nokomis, Fla.; Dale E. Dolence, Carbondale, Ill.

[73] Assignee: Lustour Corporation, Murphysboro, Ill.

[21] Appl. No.: 76,321

[22] Filed: Jul. 22, 1987

[51] Int. Cl.[4] ..... A63F 1/00

[52] U.S. Cl. ..... 273/138 R; 273/270; 273/287; 273/293; 283/72

[58] Field of Search ..... 273/148 R, 139, 287, 273/293, 138 R, 269, 270; 206/459; 283/72, 79; 428/515

[56] References Cited

U.S. PATENT DOCUMENTS

| | | | |
|---|---|---|---|
| 3,245,687 | 4/1966 | Irwin | 273/293 |
| 3,249,286 | 5/1966 | Palmer | 229/55 |
| 3,402,694 | 9/1968 | Christman | 273/270 |
| 3,603,592 | 9/1971 | Bury | 273/269 |
| 4,140,320 | 2/1979 | Cortimilia | 273/293 |
| 4,285,520 | 8/1981 | Small | 273/240 |
| 4,440,824 | 4/1984 | Bonis | 428/216 |
| 4,509,759 | 4/1985 | Small | 273/269 |
| 4,551,373 | 11/1985 | Conlon | 283/79 X |
| 4,577,869 | 3/1986 | Brinkman | 273/269 |
| 4,619,457 | 10/1986 | Small | 273/286 |
| 4,657,803 | 4/1987 | Pernicano | 428/200 |

*Primary Examiner*—Carlton R. Croyle
*Assistant Examiner*—Theodore Olds
*Attorney, Agent, or Firm*—Mann, McWilliams, Zummer & Sweeney

[57] ABSTRACT

A promotional game particularly adapted for use in connection with packaged food products, the game including a plurality of specially constructed game cards. Each game card consists of a transparent film laminate on which is imprinted a set of game indicia, which will vary from card to card. The card consists of a film laminate including a core layer of biaxially oriented polymeric film on which is printed the game indicia, which is then coated with adhesive, and laminated with a layer of transparent, grease and oil resistant, polymeric film. The game is played by removing cards from packages and placing them in overlying register with each other to determine whether that combination is a game winner.

5 Claims, 1 Drawing Sheet

PROMOTIONAL GAME

BACKGROUND OF THE INVENTION

Numerous games have been provided which utilize one transparent element disposed over an underlying game board. See, for example, U.S. Pat. Nos. 4,285,520, 4,509,759, 4,577,869 and 4,619,457. Other apparatus have been provided utilizing a background card and a transparent overlay. In this regard, see U.S. Pat. Nos. 3,402,694 and 3,603,592. None of these arrangements, however, have specifically addressed a promotional game which is particularly adapted for use in connection with the sale of packaged food products. Special problems exist when a game card is to be placed in a package containing food wherein the card will come in contact with the food product. It is essential that the printing on the card be protected from contact with oils or other liquids which may emanate from the food product. The United States Food and Drug Administration allows only a small number of vegetable-based inks to be used in materials that are in direct contact with food. In addition to protecting the printing ink on the game card, the food product must also be protected from ink or odor contamination coming from the game card. None of the prior art game arrangements have considered or addressed this problem.

SUMMARY OF THE INVENTION

The present invention provides a promotional game which includes a plurality of specially constructed game cards, each bearing a set of game indicia. Each game card is specially constructed such that the printing on the card is protected against contact with moisture from the packaged food product. Each card is a film laminate consisting of a transparent core layer of polymeric film printed with a variable set of game indicia designed to correspond with the indicia printed on the other game cards. The printed core layer is then covered with a layer of adhesive which, in turn, is coated, on one or both sides, with a layer of transparent, grease and moisture resistant, polymeric film which seals the printing from contact with food oils. The game is played by removing the specially constructed game cards from food packages and placing them in overlying register with each other such that the combination of game cards will immediately indicate whether it is a winning combination.

DETAILED DESCRIPTION

Figure 1:
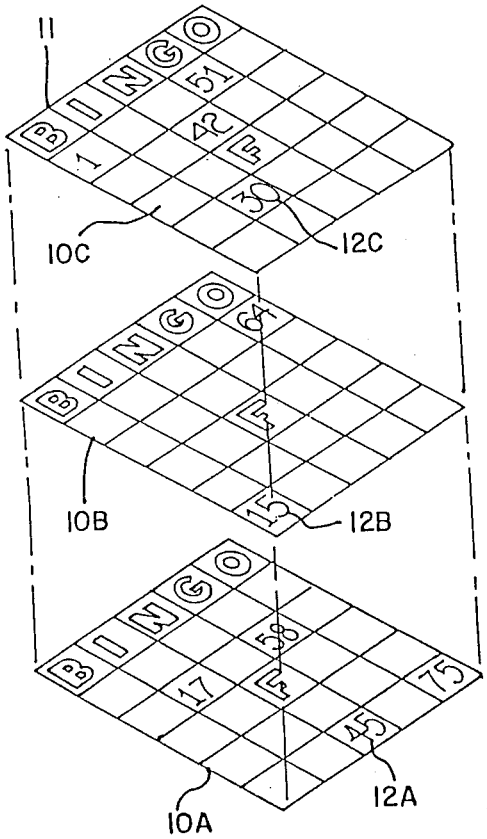
FIG. 1 is a perspective view showing three game cards of the present invention in overlying relationship with each other.

FIG. 1 illustrates three game cards 10A, 10B and 10C on each of which is imprinted a game board design 11 consisting of a standard Bingo board well known to all. The game board includes five vertical rows and five horizontal rows of squares. A first set of game indicia 12A is printed within certain of the squares of the bottom game card 10A as, for example, the number 17 appearing under the vertical row "I", the number 45 appearing in the vertical row under "N", the number 58 appearing under the vertical row "G", and the number 75 appearing under the vertical row "O". Additionally, on all game cards, the center square bears the designation "F", indicating that this is a "free" square utilizable to make vertical rows, horizontal rows, or diagonal rows in order to provide a winning combination. Somewhere on or in the package is a listing of all of the rules and other information necessary for playing the game and for redemption of awards. It is the intention that all game cards will be identical in configuration the only variation being the game indicia printed thereon.

Included within each package of the promotion is one or more of the specially designed game cards 10. The game card 10B includes a second set of game indicia 12B consisting of the number 15 appearing under the vertical row B and the number 64 appearing under the vertical row O. The game card 10C includes a third set of game indicia 12C including the numbers 1, 30, 42 and 51 as shown in FIG. 1.

Figure 3:
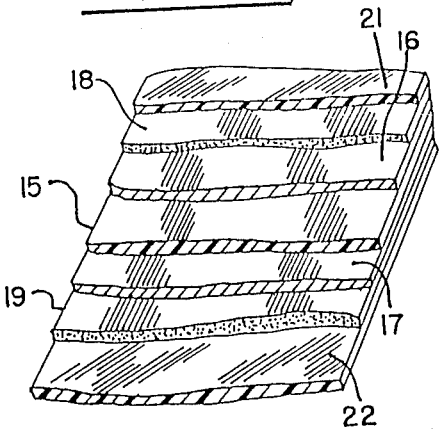
FIG. 3 is a perspective view, partially broken away, showing one embodiment of the game card.
Figure 4:
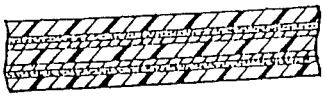
FIG. 4 is a side view showing the various elements of the film laminate shown in FIG. 3.

The structure of one embodiment of game card 10 is illustrated in FIGS. 3 and 4 and may be similar to that disclosed in applicant's copending application Ser. No. 036,388, filed Apr. 9, 1987. This embodiment includes a central core layer 15 of transparent biaxially oriented polymeric film. The core layer 15 of this embodiment is a clear three mil polystyrene, but any biaxially oriented, transparent, polymeric film that can receive printing inks may be used. Polystyrene is preferred because of its ability to produce high quality graphics when printed, offering a variety of printing capabilities.

The relative thickness of the composite layers of the laminate may, of course, vary within the limits which will be recognized by those skilled in the art.

In the embodiment of FIG. 3, the core layer 15 is then printed on one or both sides, as illustrated at 16 and 17. The printing includes the game indicia 12 illustrated in FIG. 1. Every game card 10 is printed with the "free" space in the middle and certain other numbers. The positioning of numbers on the game card 10 is in spaces other than those already used on the other game cards. Hence, when the game cards are placed in overlying register with each other, a total of ten numbered squares and one "free" square are visible. The combination of these eleven occupied squares will result in the following Bingo possibilities:

(a) five different horizontal positions;
(b) five different vertical positions;
(c) two different diagonal positions;
(d) any other format, such as four corner Bingo which the promoter wishes to designate.

The number of winning combinations available is directly controllable by the number of these combinations printed. The randomization of losing cards is limited only to the extent of conceived need.

The methods of printing which have been found suitable include rotogravure printing and flexographic process printing. Other printing techniques may also be utilized. The variety of inks which may be used is wide in scope since the net effect of the laminated insert is to prevent contact between the ink and the food product. One ink which has been found to be effective is one sold by American Inks and Coatings and designated as opticite type ink R-22811-F1. The core layer 15 may be printed on either side or possibly on both sides.

For purposes of explanation, it will be assumed that the embodiment of FIG. 3 has a central core layer 15 with game indicia printed on both sides at 16 and 17. Each layer of printing is then coated on its exterior surface by a layer of adhesive illustrated in FIGS. 3 and 4 as layers 18 and 19, respectively. This is preferably accomplished during an in-line adhesive lamination process. Adhesives which have been found to be acceptable in formulating the insert of the present invention include a two-component solvent base urethane prepolymer adhesive which is a mixture of Lamal HSA and Catalyst C in proportions as specified by the manufacturer. A two-component, water-borne adhesive has also been used consisting of a mixture of Morton Chemical Company Adcote 77T660 and Adcote 9T5, again in proportions as specified by the manufacturer. For hand lamination, a pressure-sensitive adhesive sold by Morton Chemical Company under the designation Adcote 333 has also been used.

Next, outer layers 21 and 22 are laminated over the layers 18 and 19, respectively. The outer layers 21 and 22 consist of any of a variety of transparent, grease and moisture resistant, polymeric films. One such film which has been utilized successfully in the practice of the present invention is a biaxially oriented polypropylene sold by Curwood, Inc. under the trademark CURPHANE 703. Depending on the need for stiffness and thickness, a transparent, grease-resistant, biaxially oriented polystyrene may be used for the outer layers 21 and 22. Use of polystyrene for these layers substantially stiffens the game card. One such polystyrene which has been found to be acceptable is sold by Dow Chemical Company under the designation "clear opticite" Xu65021.02.

The manufacture of the game card disclosed herein and illustrated in FIGS. 3 and 4 is preferably accomplished by an adhesive lamination of the composite sheet. Use of oriented polypropylene in the outer layers 21 and 22 provides a clear, protective covering for the inks and core layer. Use of clear, biaxially oriented polystyrene for these layers offers a stiffer finished structure. The outside layers of grease-resistant film can vary in thickness. In general, acceptable thicknesses range between 0.5 mil and 4 mils in thickness. The core layer is preferably transparent polystyrene.

Certain preferred embodiments of this invention and methods of making the laminate are illustrated in the following specific examples:

No. 1. A central core layer of 3 mil clear polystyrene was rotogravure printed, both sides in register, with American Inks and Coatings opticite type ink R-22811F1. This structure was then in-line adhesive laminated on both sides to an outer layer of 50GA oriented polypropylene, Curwood, CURPHANE 703, with a layer of adhesive designated as Morton Chemical Company Adcote 77T660 and Adcote 9T5.

No. 2. A central core layer of 3 mil clear polystyrene was rotogravure printed, both sides in register, with American Inks and Coatings opticite type ink R-22811, F1. This structure was then in-line adhesive laminated on both sides to an outer layer of 50 GA oriented polypropylene, Curwood, CURPHANE 703, with a layer of adhesive designated as Morton Chemical Company Lamal HSA and Catalyst C.

No. 3. A number of samples were also hand laminated utilizing a central core layer of 3 mil clear polystyrene printed on both sides with the same ink as set forth in Examples 1 and 2, and then laminated on both sides to a variety of gauges of clear opticite, Dow Chemical Company (polystyrene), utilizing a layer of pressure-sensitive adhesive designated as Morton Chemical Company, Adcote 333.

Rolls of each of the laminates described in Examples 1, 2, and 3 were then taken to an off-line sheeter and sheeted. During this process, a food grade, anti-static powder was applied to the web, in order to control static through the rest of the manufacturing processes as well as in the placing machine utilized by the packager. The sheeted material was then jogged and guillotine cut into the 3.5×2.5 inch finished game cards.

The game card 10 of the present invention need not be printed on both sides. One embodiment which has been determined to be acceptable includes a core layer 15 containing a layer of printing 16 over which is disposed a layer of adhesive 18 coated with a layer of transparent, grease and moisture resistant, polymeric film 21. When the insert is printed on only one side, it is unnecessary to utilize the layer of adhesive 19 and the outer layer of polymeric film 22. Alternatively, if greater protection is desired, the core layer 15 may be printed on one side 16 or 17 and coated on both sides with respective layers of adhesive and polymeric film as at 18, 21, and 19, 22. The construction of the laminated game card prevents tampering or alteration of the indicia printed thereon, which provides added security for the game promoter. The promoter may determine how many game indicia will appear on each game card 10 and further determine how many game cards will be required for a successful combination.

The nature of the game is designed to be extremely simple and one in which the game player can immediately determine whether the combination of game cards in his possession produces a winner. Any of a wide variety of games can be utilized incorporating the essential features of this invention including, but not limited to, game formats which indicate an object or person in motion which requires registration of one or more cards overlying said game board but not specifically requiring a grid-matrix format. The Bingo game illustrated and described herein is only one format.

To play the Bingo game disclosed herein, the purchaser of the packaged product simply opens each package he purchases in connection with the promotion and removes the game card 10 contained therein which has been in contact with the food product in the package. As a result of the construction of the transparent film laminate, the printed game indicia 12 appearing on the game card have been protected from contact with the oils and greases which emanate from the food product contained in the package. Depending upon the makeup of the food product contained in the package, the most that will be required for utilization of the game card is to wipe off any residue that may have been deposited thereon.

Figure 2:
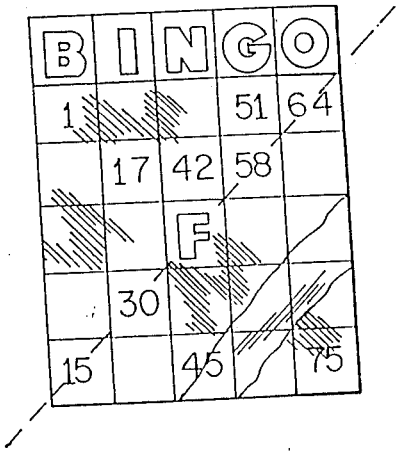
FIG. 2 is a top view showing the game cards placed in overlying relationship with each other so as to disclose a winning combination.

The game player then places all cards 10 which he has accumulated in overlying register with each other such that the upper squares of each card which read "Bingo" overlie their corresponding counterparts on the other cards. Due to the transparent nature of the cards 10, the game player can then view the display which results from the combination of the cards, as best illustrated in FIG. 2. The combination shown in FIG. 2 is a winning combination, which produces a diagonal series of numbers as, for example, the numbers 15, 30, F, 58, and 64.

The promoter can determine, based on the circumstances of the promotion, whether, and to what extent, a winning combination will result in a prize award. In connection with most promotional games, it is required that the promoter furnish a set of game cards free of charge. For that reason, separate sets of game cards must be available to send to those who request them.

The game could also be incorporated into promotions that don't end up in a package. Restaurants could print game cards on place mats and hand out other game cards with the purchase of meals. Fast food chains could hand out sets of the game cards with purchases.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A promotional game including a plurality of grease and moisture resistant game cards consisting of a transparent film laminate including a core layer of transparent biaxially oriented polymeric film printed with a set of game indicia particularly adapted to correspond with game indicia printed on other game cards, a layer of adhesive disposed over said core layer, a layer of transparent, grease and moisture resistant, polymeric film disposed over said layer of adhesive whereby said adhesive and film layers seal and protect said game indicia from contamination or alteration, said game played by placing said game cards in register with, and overlying each other such that the combined game cards will immediately indicate whether such combination is a game winner.

2. A promotional game as in claim 1 in which said core layer of said game card is printed on one side with said game indicia and is coated on both sides with said layer of adhesive and subsequently coated on both sides with said layer of transparent, grease and moisture resistant, polymeric film.

3. A promotional game as in claim 1 in which said transparent core layer consists of clear, biaxially oriented polystyrene.

4. A promotional game as in claim 1 in which said layer of transparent, grease and moisture resistant, polymeric film consists of polypropylene.

5. A promotional game as in claim 1 in which said layer of transparent, grease and moisture resistant, polymeric film consists of polystyrene.

* * * * *